US011859951B2

(12) United States Patent
Hoelzl et al.

(10) Patent No.: US 11,859,951 B2
(45) Date of Patent: Jan. 2, 2024

(54) ELECTRONIC IRRITATION DEVICE

(71) Applicant: Diehl Stiftung & Co. KG, Nuremberg (DE)

(72) Inventors: Johannes Hoelzl, Erlangen (DE); Robert Stark, Bad Windsheim (DE); Oliver Klettke, Nuremberg (DE); Mathias Glasmacher, Reilingen (DE); Wolfgang Cabanski, Heilbronn (DE)

(73) Assignee: Diehl Stiftung & Co. KG, Nuremberg (DE)

( * ) Notice: Subject to any disclaimer, the term of this patent is extended or adjusted under 35 U.S.C. 154(b) by 411 days.

(21) Appl. No.: 17/246,899

(22) Filed: May 3, 2021

(65) Prior Publication Data

US 2021/0254937 A1 Aug. 19, 2021

Related U.S. Application Data

(63) Continuation of application No. PCT/EP2019/079436, filed on Oct. 28, 2019.

(30) Foreign Application Priority Data

Nov. 2, 2018 (DE) ..... 102018008647

(51) Int. Cl.
*F41H 13/00* (2006.01)

(52) U.S. Cl.
CPC ..... *F41H 13/0081* (2013.01); *F41H 13/0087* (2013.01)

(58) Field of Classification Search
CPC ..... F42B 12/36; F42B 12/42; F42B 27/00; F42B 8/12; F42B 12/32; F42B 12/50; F41H 13/0056; F41H 13/0087; F41H 13/0081; F41A 33/02
USPC ..... 362/112, 113, 249.02; 315/56, 58; 102/260, 334, 360, 368, 367, 502
See application file for complete search history.

(56) References Cited

U.S. PATENT DOCUMENTS

| | | | | |
|---|---|---|---|---|
| 4,444,111 | A | 4/1984 | Luebbers | |
| 6,767,108 | B1 * | 7/2004 | Blachowski | F42B 12/36 315/56 |
| 8,726,810 | B2 * | 5/2014 | Kravel | F42B 12/56 102/260 |

(Continued)

FOREIGN PATENT DOCUMENTS

| | | |
|---|---|---|
| DE | 2842797 C2 | 1/1986 |
| EP | 3023730 A1 | 5/2016 |

(Continued)

*Primary Examiner* — Michael D David
(74) *Attorney, Agent, or Firm* — Laurence A. Greenberg; Werner H. Stemer; Ralph E. Locher

(57) ABSTRACT

An electronic irritation device includes a plurality of electronic irritation signal modules. Each of the modules has at least one emitter for emitting optical or acoustic irritation signals, and additionally a connection device for coupling the plurality of irritation signal modules to one another and an unlocking device for automatically unlocking the connection device in order to decouple the plurality of irritation signal modules from one another and thereby distribute them spatially. Distributing a plurality of irritation signal modules makes it possible to increase the probability of an irritation effect upon deployment of a single irritation device.

13 Claims, 3 Drawing Sheets

(56) References Cited

U.S. PATENT DOCUMENTS

| | | | | |
|---|---|---|---|---|
| 8,899,156 | B1 * | 12/2014 | Tseng | F42B 12/36 102/482 |
| 2008/0216699 | A1 | 9/2008 | McAleer et al. | |
| 2013/0239838 | A1 * | 9/2013 | Kravel | F42B 27/00 102/487 |
| 2017/0116874 | A1 * | 4/2017 | Holcomb | G09B 9/003 |
| 2018/0135954 | A1 * | 5/2018 | Thomas | F42C 14/02 |
| 2021/0254936 | A1 * | 8/2021 | Hoelzl | F42B 27/00 |
| 2021/0254937 | A1 * | 8/2021 | Hoelzl | F41H 13/0081 |
| 2021/0270577 | A1 * | 9/2021 | Hoelzl | H05B 47/16 |

FOREIGN PATENT DOCUMENTS

| | | | |
|---|---|---|---|
| EP | 3023731 | A1 | 5/2016 |
| GB | 2555865 | A | 5/2018 |
| WO | 2014066917 | A1 | 5/2014 |
| WO | 2014121480 | A1 | 8/2014 |
| WO | 2016064851 | A1 | 4/2016 |

* cited by examiner

ELECTRONIC IRRITATION DEVICE

CROSS-REFERENCE TO RELATED APPLICATION

This application is a continuation, under 35 U.S.C. § 120, of copending international application No. PCT/EP2019/079436, filed Oct. 28, 2019, which designated the United States; this application also claims the priority, under 35 U.S.C. § 119, of German patent application No. DE 10 2018 008 647.0, filed Nov. 2, 2018; the prior applications are herewith incorporated by reference in their entirety.

BACKGROUND OF THE INVENTION

Field of the Invention

The present invention relates to an electronic irritation device for emitting optical and/or acoustic irritation signals.

So-called flash grenades (stun grenades, flashbangs) are used to disorient people and confuse sensor systems. They are intended to bring about short-time blindness and disorientation through the emission of pulsed light at high intensity. Besides pyrotechnic flash and/or stun grenades, in which the optical or acoustic pulses are generated by means of an explosion reaction, electronic flash and/or stun grenades are also known in which the optical or acoustic pulses are generated by electronic emitters that are controllable by a control device. Such electronic dazzling elements are disclosed, for example, in the commonly assigned European patent applications EP 3 023 730 A1 and EP 3 023 731 A1.

BRIEF SUMMARY OF THE INVENTION

It is accordingly an object of the invention to provide an irritation device which overcomes a variety of disadvantages of the heretofore-known devices of the general type and which provides for an improved electronic irritation device which has an increased probability of an irritation effect.

With the above and other objects in view there is provided, in accordance with the invention, an electronic irritation device, comprising:

- a plurality of irritation signal modules, each comprising at least one emitter for emitting optical or acoustic irritation signals;
- a connection device for coupling said plurality of irritation signal modules to one another; and
- an unlocking device for automatically unlocking said connection device in order to decouple said plurality of irritation signal modules from one another.

In other words, the electronic irritation device according to the invention, which may also be referred to as a dazzling device, comprises a plurality of electronic irritation signal modules, each comprising at least one emitter for emitting optical or acoustic irritation signals, and additionally contains a connection device for coupling the plurality of irritation signal modules to one another and an unlocking device for automatically unlocking the connection device in order to decouple the plurality of irritation signal modules from one another.

The invention proposes coupling a plurality of electronic irritation signal modules to one another in order to be able to deploy them jointly in a single irritation device, and then automatically decoupling them from one another by means of an unlocking device in order to distribute them spatially. By jointly deploying and subsequently distributing a plurality of irritation signal modules, it is possible to increase the probability of irritation of one or more persons and/or one or more sensor systems, whereby an increased diversion effect can be achieved.

The electronic irritation device of the invention comprises a plurality—i.e., two or more—of electronic irritation signal modules. The plurality of irritation signal modules each comprise one or more emitters for emitting optical or acoustic irritation signals. An irritation signal module can optionally comprise only optical emitters, only acoustic emitters or both optical emitters and acoustic emitters. The plurality of irritation signal modules can be configured identically or differently to one another with regard to the type and number of the emitters. The optical emitters preferably contain electronic illuminants, preferably LEDs or laser diodes or LED arrays or laser arrays, and the acoustic emitters preferably contain electronic sound generators such as piezo sound transducers, for example.

The plurality of irritation signal modules are coupled to one another by means of a connection device, i.e. are combined to form a unit in the initial state of the irritation device. This unit preferably forms a projectile that can be deployed. The decoupling of the irritation signal modules, i.e. the decomposition of the projectile unit, is effected automatically by means of an unlocking device in order to distribute the plurality of irritation signal modules spatially after the deployment of the projectile, i.e. after the launching thereof or the impact thereof.

Preferably, the irritation device furthermore comprises at least one activation mechanism for activating the release of the plurality of irritation signal modules from one another and at least one control device for actuating the unlocking device directly upon or a predetermined time after an activation by the at least one activation mechanism. The at least one activation mechanism preferably comprises an activation switch, a disengaging mechanism, a sensor for detecting an operating situation and/or a communication device for receiving an activation command. The sensor for detecting an operating situation is preferably selected from a distance sensor for detecting a distance between the irritation signal module or the irritation device and an object, a position sensor (e.g. GPS or GNSS system) and an acceleration sensor for recognizing launching or impact of the irritation device. The sensor for detecting an operating situation can be for example a corresponding sensor of an irritation signal module or a separate sensor in/on the irritation device. The at least one control device for actuating the unlocking device is preferably a respective control device of all the irritation signal modules, a master control device of the irritation signal modules or a separate control device of the irritation device.

In one configuration of the invention, the irritation device furthermore comprises an expansion mechanism for driving apart the irritation signal modules after the connection device has been unlocked. The spatial distribution of the irritation signal modules after the decoupling thereof can be assisted or improved with the aid of the expansion mechanism. The expansion mechanism preferably comprises a mechanical spring mechanism composed of metal or plastic, which is tensioned in the coupled state of the irritation signal modules, or a gas cartridge that is opened upon the connection device being unlocked.

In one embodiment variant of the invention, the connection device comprises connection elements, via which the plurality of irritation signal modules are connected to one another, and the unlocking device comprises unlocking mechanisms for unlocking the connection elements and releasing the irritation signal modules from one another. The connection device can comprise one or more connection elements, each of which connects two or more irritation signal modules to one another. The unlocking device can comprise one or more unlocking mechanisms, each of which can unlock one or more connection elements of the connection device. The connection device can comprise mechanical, electrical or magnetic connection elements, for example.

In another embodiment variant of the invention, the connection device comprises a housing, in which the plurality of irritation signal modules are accommodated and which is composed of a plurality of housing segments connected to one another via connection elements, and the unlocking device comprises unlocking mechanisms for unlocking the connection elements and releasing the housing segments from one another. The housing is preferably embodied as substantially cylindrical, spherical or parallelepipedal. The housing can be composed of two or more housing segments, for example in the form of housing shells. The connection device can comprise one or more connection elements, each of which connects two or more housing segments to one another. The unlocking device can comprise one or more unlocking mechanisms, each of which can unlock one or more connection elements of the connection device.

In another embodiment variant of the invention, the connection device comprises a housing, in which the plurality of irritation signal modules are accommodated, and the unlocking device comprises a mechanism for destroying the housing. The housing is preferably embodied as substantially cylindrical, spherical or parallelepipedal. The destruction of the housing functions explosively, for example.

In another embodiment variant of the invention, the connection device comprises a housing, which is fragile and, in the event of the irritation device being impacted, breaks up and frees the plurality of irritation signal modules. The housing is preferably embodied as substantially cylindrical, spherical or parallelepipedal. The fragile housing is formed from a brittle plastic, glass or ceramic material, for example.

In one configuration of the invention, each of the plurality of irritation signal modules comprises a control device for controlling the at least one emitter and a communication device connected to the control device, such that the control devices of the irritation signal modules can communicate with one another and/or with a superordinate controller in order to coordinate the control of the emitters of the various irritation signal modules among one another. In this case, the control of the emitters comprises, in particular, the setting of amplitude, phase, frequency and pattern of the optical or acoustic pulses.

In one configuration of the invention, at least one of the plurality of irritation signal modules comprises a control device for controlling the at least one emitter and a distance sensor for detecting a distance between the irritation signal module and an object, said distance sensor being connected to the control device, wherein the control device is configured to control the at least one emitter of the irritation signal module depending on the detected distance with respect to an object. For example, parameters of the pulses such as, in particular, the amplitudes and frequencies thereof can be set optimally on the basis of the detected distance data. Preferably, all of the plurality of irritation signal modules are equipped with such a control device and such a distance sensor.

In one configuration of the invention, at least one of the plurality of irritation signal modules comprises an integrated energy store. Preferably, all of the plurality of irritation signal modules comprise an integrated energy store. Preferably, the energy store is a rechargeable energy store. The energy store can be charged contactlessly (e.g., inductively) or by way of a connecting plug.

In one configuration of the invention, the plurality of irritation signal modules each comprise a self-destruction device for the self-destruction of the irritation signal module. Self-destruction, which is preferably triggered by remote control, can prevent third parties from taking possession of an irritation signal module and using it against oneself.

Other features which are considered as characteristic for the invention are set forth in the appended claims.

Although the invention is illustrated and described herein as embodied in an electronic irritation device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
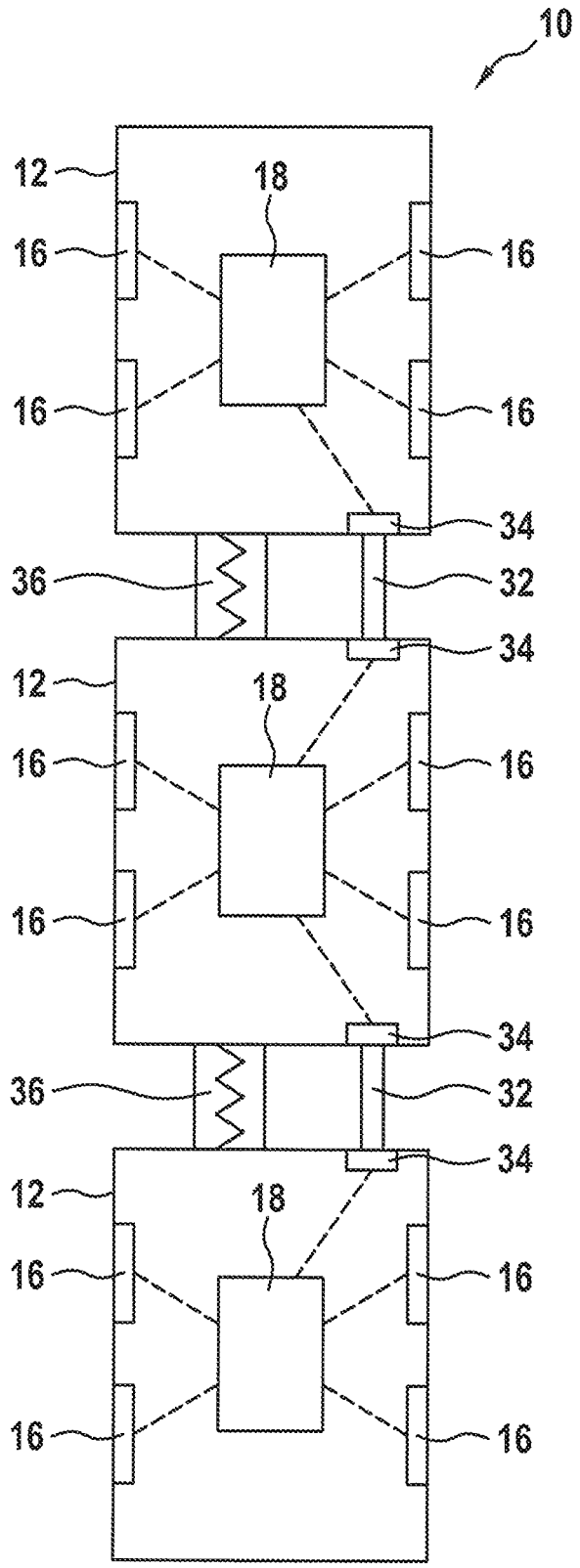
FIG. 1 shows a basic illustration of an electronic irritation device in accordance with a first exemplary embodiment of the present invention.

Referring now to the figures of the drawing in detail and first, in particular, to FIG. 1 thereof, there is shown a basic configuration of a first exemplary embodiment of an electronic irritation device according to the invention.

The irritation device 10 comprises a plurality (here: three) of electronic irritation signal modules 12. Each of these irritation signal modules 12 contains a plurality of emitters 16, preferably at least one optical emitter 16 and at least one acoustic emitter 16. The optical emitters 16 contain electronic illuminants such as, for example, LEDs, LED arrays, laser diodes or laser arrays, and the acoustic emitters 16 contain electronic sound generators such as piezo sound transducers, for example. In addition, each of these irritation signal modules 12 contains a control device 18, which is connected to the emitters 16 in a wired or wireless manner for the purpose of controlling the emitters 16.

As illustrated in FIG. 1, each of the irritation signal modules 12 is substantially cylindrical in shape and they are stacked one above another. In addition, two of the irritation signal modules 12 in each case are connected to one another via a for example mechanical or electromagnetic connection element 32, such that all the irritation signal modules 12 are coupled to one another and form a unit that can be deployed as a common projectile. As illustrated in FIG. 1, the irritation signal modules 12 are each provided with at least one (e.g. mechanical and/or electrical) unlocking mechanism 34, by which one of the connection elements 32 can be unlocked, such that the irritation signal modules 12 can be released from one another and thus distributed spatially.

In the exemplary embodiment in FIG. 1, moreover, in each case a mechanical expansion mechanism 36 comprising a spring composed of metal or plastic is provided between each two irritation signal modules 12. These springs are tensioned in the initial state of the irritation device 10, in which the irritation signal modules 12 are coupled to one another via the connection elements 32. If the connection elements 32 are unlocked and the irritation signal modules 12 are thus released from one another, then the expansion mechanisms 35 force the irritation signal modules 12 apart and thereby assist and accelerate the spatial distribution thereof.

Figure 2:
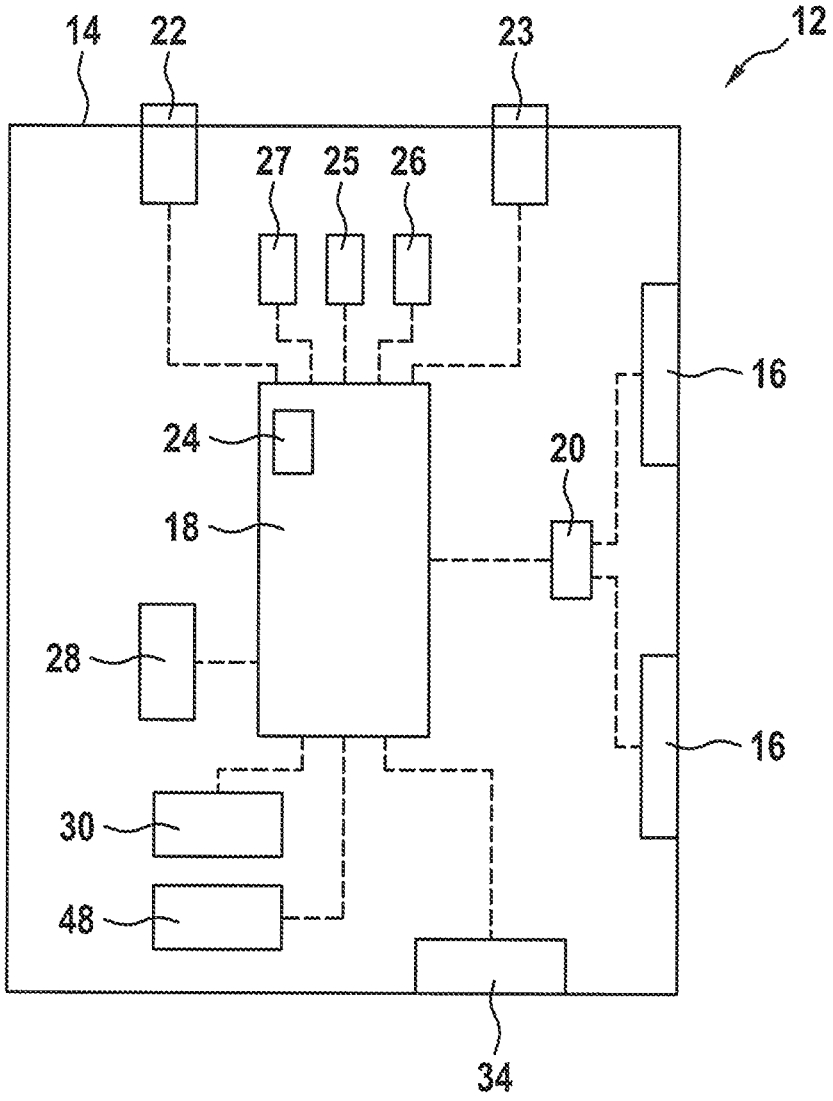
FIG. 2 shows an enlarged basic illustration of an irritation signal module of the electronic irritation device from FIG. 1.

Referring now to FIG. 2, there is shown a more detailed construction of an irritation signal module 12 from FIG. 1.

The components of the irritation signal module 12 are arranged in/on a module housing 14. The optical/acoustic emitters 16 are positioned for example on the cylinder circumference of the module housing 14. They are controlled by the control device 18, preferably via an interposed driver 20, in order to set in particular the amplitudes, frequencies, phases and signal patterns of the optical/acoustic irritation pulses emitted.

The control device 18 is additionally connected to an activation switch 22 and/or a disengaging mechanism 23, which can be actuated before the irritation device is launched, for example. Moreover, the control device 18 preferably contains a timer 24. Furthermore, the irritation signal module 12 comprises a (for example, electromagnetic or acoustic or optical) distance sensor 25 for detecting a distance between the irritation signal module 12 and an object, a position sensor 26 for detecting a position of the irritation signal module 12 (for example, by means of a GPS or GNSS system) and/or an acceleration sensor 27 for detecting launching or impact of the irritation signal module 12. In the exemplary embodiment in FIG. 2, the irritation signal module 12, in an optional addition, contains a communication device 28. The sensors 25, 26, 27 and the communication device 28 are likewise connected to the control device 18.

The activation switch 22, the disengaging mechanism 23, the sensors 25, 26, 27 and the communication device 28 serve as an activation mechanism for activating the control device 18 in order that the latter, directly upon the activation or—with the aid of the timer 24—a predetermined time after the activation, actuates the unlocking mechanism 34 for unlocking the connection element 32 in order to release the irritation signal modules 12 from one another. In this regard, the irritation signal modules 12 can be released from one another for example a predetermined time duration after an actuation of the activation switch 22 or of the disengaging mechanism 23, upon the object distance detected by the distance sensor 25 falling below a predetermined limit value, upon a predetermined position being reached by the irritation device 10, a predetermined time duration after launching or impact of the irritation device 10.

The object distance detected by the distance sensor 25 can additionally be used by the control device 18 to adapt the optical or acoustic irritation signals emitted by the emitters 16 to the object distance. By way of example, the brightness of light pulses can be adapted to the object distance.

The communication device 28 can be used for receiving an activation signal from a remote control. In addition, the communication device 28 can be used for the communication of the control devices 18 of the irritation signal modules 12 of the irritation device 10 with one another. In this regard, for example, an activation effected at one irritation signal module 12 (e.g., by way of an actuation of the disengaging mechanism 23) can be communicated to the other irritation signal modules 12 or the control devices 18 thereof, such that the unlocking mechanisms 34 of all the irritation signal modules 12 can be actuated synchronously. In this way, moreover, the irritation signals of the emitters 16 of the various irritation signal modules 12 can be coordinated with one another. By way of example, the light pulses or sound pulses can be emitted synchronously or in a well-defined pattern.

As illustrated in FIG. 2, the irritation signal module 12 is preferably also equipped with an energy storage device 30, preferably a rechargeable energy store, for supplying energy to the electronic components of the irritation signal module 12.

Moreover, the irritation signal module 12 is optionally also provided with a self-destruction device 48. If third parties gain possession of an irritation signal module 12 and there is the risk of their using the irritation signal module 12 against oneself, then the self-destruction device 48 can be activated by remote control via the communication device 28 in order to destroy the irritation signal module 12, in particular the control device 18 thereof.

Figure 3:
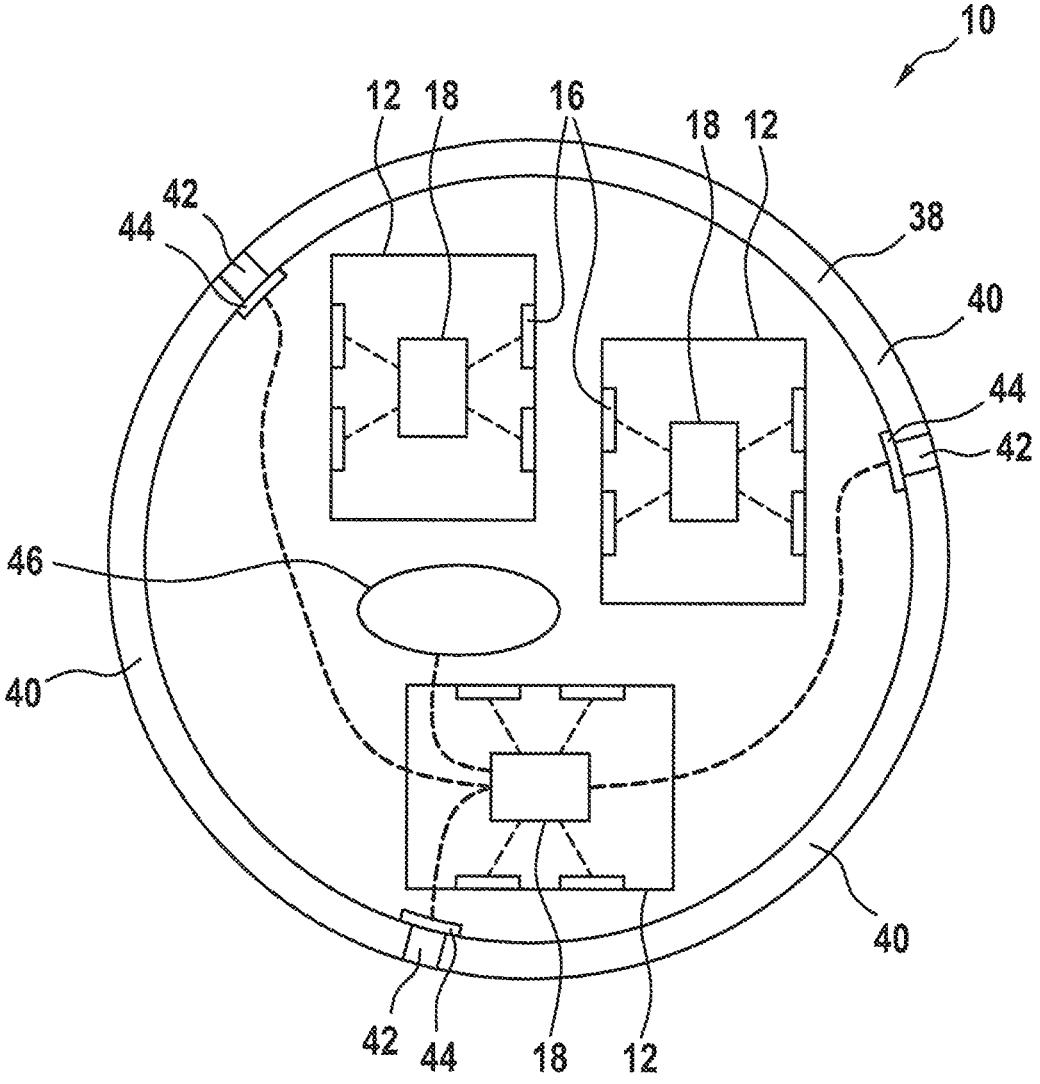
FIG. 3 shows a basic illustration of an electronic irritation device in accordance with a second exemplary embodiment of the present invention.

FIG. 3 shows the basic construction of a second exemplary embodiment of an electronic irritation device of the invention. Identical or functionally corresponding components are provided with the same reference numerals as in FIG. 1.

In the exemplary embodiment in FIG. 3, a plurality (here: three) of substantially cylindrical irritation signal modules 12 are accommodated in a substantially spherical or cylindrical housing 38. Accommodation in a common housing 38 has the result that the irritation signal modules 12 are coupled to one another and a unit serving as a projectile is formed.

In the exemplary embodiment in FIG. 3, the housing 38 is composed of a plurality of housing segments 40 in the form of housing shells. The housing segments 40 are connected to one another by for example mechanical or electromagnetic connection elements 42. In the region of the connection elements 42, moreover, for example mechanical or electrical unlocking mechanisms 44 are provided, by which the connection elements 42 can be unlocked and the housing segments 40 are thereby released from one another, such that the housing 38 opens and frees the irritation signal modules 12. In order to assist or accelerate the spatial distribution of the freed irritation signal modules 12, the irritation device 10 optionally contains an expansion mechanism 46 for example in the form of a gas cartridge.

In the exemplary embodiment in FIG. 3, the control device 18 of one of the irritation signal modules 12 is used as a master controller. This master controller detects an activation by an activation mechanism and then controls the unlocking mechanisms 44 for unlocking the connection elements 42. The activation mechanism can be part of the irritation signal module 12 with the master controller 18 (see FIG. 2 above) or can be provided separately in/on the housing 38 of the irritation device 10. Moreover, instead of a master controller of the control devices 18 of the irritation signal modules 12, a separate controller can be provided in the irritation device 10.

For the rest, the second exemplary embodiment in FIG. 3 corresponds to the first exemplary embodiment in FIG. 1. In particular, the irritation signal modules 12 of the irritation device 10 in FIG. 3 can also be configured in accordance with FIG. 2.

In a further exemplary embodiment, as an embodiment variant of the second exemplary embodiment, a housing 38 can be used which can be destroyed by a mechanism in order to free the irritation signal modules 12.

In a further exemplary embodiment, as a further embodiment variant of the second exemplary embodiment, a housing 38 can be used which breaks up in the event of impact and thus frees the irritation signal modules 12. For this purpose, the housing 38 is shaped from a brittle material, for example.

The following is a summary list of reference numerals and the corresponding structure used in the above description of the invention:

10 Electronic irritation device
12 Electronic irritation signal modules
14 Module housing
16 Emitter
18 Control device
20 Driver
22 Activation switch
23 Disengaging mechanism
24 Timer
25 Distance sensor
26 Position sensor
27 Acceleration sensor
28 Communication device
30 Energy store
32 Connection element
34 Unlocking mechanism
36 Expansion mechanism
38 Housing
40 Housing segments
42 Connection elements
44 Unlocking mechanism
46 Expansion mechanism
48 Self-destruction device

The invention claimed is:

1. An electronic irritation device, comprising:

a plurality of irritation signal modules, each comprising at least one emitter for emitting optical or acoustic irritation signals;

a connection device for coupling said plurality of irritation signal modules to one another; and an unlocking device for automatically unlocking said connection device in order to decouple said plurality of irritation signal modules from one another.

2. The irritation device according to claim 1, which further comprises at least one activation mechanism for activating a release of said plurality of irritation signal modules from one another and at least one control device for actuating said unlocking device upon an activation by said at least one activation mechanism.

3. The irritation device according to claim 2, wherein said control device is configured to actuate said unlocking device directly upon, or a predetermined time after, the activation by said at least one activation mechanism.

4. The irritation device according to claim 2, wherein said at least one activation mechanism comprises at least one device selected from the group consisting of an activation switch, a disengaging mechanism, a sensor for detecting an operating situation, and a communication device for receiving an activation command.

5. The irritation device according to claim 1, which further comprises an expansion mechanism for driving apart said irritation signal modules after said connection device has been unlocked.

6. The irritation device according to claim 1, wherein:

said connection device comprises connection elements configured to connect said plurality of irritation signal modules to one another, and said unlocking device comprises unlocking mechanisms for unlocking said connection elements and releasing said irritation signal modules from one another.

7. The irritation device according to claim 1, wherein:

said connection device comprises a housing, in which said plurality of irritation signal modules are accommodated and which is composed of a plurality of housing segments connected to one another via connection elements; and said unlocking device comprises unlocking mechanisms for unlocking said connection elements and releasing said housing segments from one another.

8. The irritation device according to claim 1, wherein:

said connection device comprises a housing, in which said plurality of irritation signal modules are accommodated; and said unlocking device comprises a mechanism for destroying said housing.

9. The irritation device according to claim 1, wherein said connection device comprises a housing, which is fragile and formed so that, in an event that the irritation device is impacted, breaks up and frees said plurality of irritation signal modules.

10. The irritation device according to claim 1, wherein each of said plurality of irritation signal modules comprises a control device for controlling said at least one emitter and a communication device connected to said control device, wherein said control devices of said irritation signal modules are configured to communicate with one another and/or with a superordinate controller in order to coordinate a control of said emitters of the various said irritation signal modules among one another.

11. The irritation device according to claim 1, wherein at least one of said plurality of irritation signal modules comprises a control device for controlling said at least one emitter and a distance sensor for detecting a distance between said irritation signal module and an object, said distance sensor being connected to said control device and said control device being configured to control said at least one emitter of said irritation signal module depending on a detected distance from the object.

12. The irritation device according to claim 1, wherein at least one of said plurality of irritation signal modules comprises an integrated energy storage device.

13. The irritation device according to claim 1, wherein each of said plurality of irritation signal modules comprises a self-destruction device for a self-destruction of the respective said irritation signal module.

* * * * *